US008656564B2

(12) United States Patent
Chou

(10) Patent No.: US 8,656,564 B2
(45) Date of Patent: Feb. 25, 2014

(54) FASTENING FABRIC STRUCTURE

(75) Inventor: Chao-Mu Chou, Taipei (TW)

(73) Assignees: Chao-Mu Chou, Taipei (TW); Shiu-Yin Cheng, Taipei (TW)

( * ) Notice: Subject to any disclaimer, the term of this patent is extended or adjusted under 35 U.S.C. 154(b) by 819 days.

(21) Appl. No.: 12/642,847

(22) Filed: Dec. 20, 2009

(65) Prior Publication Data

US 2010/0162536 A1 Jul. 1, 2010

(30) Foreign Application Priority Data

Dec. 31, 2008 (TW) ..... 97151634 A

(51) Int. Cl.
*A44B 18/00* (2006.01)
*B32B 3/06* (2006.01)

(52) U.S. Cl.
USPC ..... 24/442; 24/445; 24/450; 428/89; 428/99; 428/100

(58) Field of Classification Search
USPC ..... 428/99, 100, 92, 903, 88, 89; 24/442, 24/445, 450, 452
See application file for complete search history.

(56) References Cited

U.S. PATENT DOCUMENTS

| | | | | |
|---|---|---|---|---|
| 4,149,540 | A * | 4/1979 | Hasslinger | 606/203 |
| 4,854,015 | A * | 8/1989 | Shaull | 24/16 R |
| 5,231,738 | A * | 8/1993 | Higashinaka | 24/446 |
| 6,099,932 | A * | 8/2000 | Gehring | 428/91 |
| 6,484,371 | B1 * | 11/2002 | Romanko et al. | 24/306 |
| 6,647,600 | B1 * | 11/2003 | Jost et al. | 24/442 |
| 7,231,789 | B2 * | 6/2007 | Chou | 66/191 |
| 8,551,596 | B2 * | 10/2013 | Chou | 428/99 |
| 2004/0074520 | A1 * | 4/2004 | Truong et al. | 134/6 |
| 2005/0250404 | A1 * | 11/2005 | Clarke | 442/340 |
| 2006/0144098 | A1 * | 7/2006 | Chou | 66/195 |
| 2009/0200348 | A1 * | 8/2009 | Smith | 224/257 |
| 2010/0313388 | A1 * | 12/2010 | Chou | 24/445 |
| 2012/0096690 | A1 * | 4/2012 | Chou | 24/445 |

* cited by examiner

*Primary Examiner* — Cheryl Juska
(74) *Attorney, Agent, or Firm* — Guice Patents PLLC

(57) ABSTRACT

A fastening fabric structure is disclosed to have a micro-fibriform loop fabric, fabricated by complex, textured micro-fiber yarn and split thereafter to recover more and smaller fibers, all of the fibers forming the micro-fibriform loops or pile loops between the inter-weaving or inter-knitting nodes, and a fibriform pile fabric, fabricated by spun yarn or synthetic filament yarn and sheared to form erected, dispersed non-hook fiber bundles of micro-fibriform pile for fastening the micro-fibriform loops of said micro-fibriform loop fabric. The erected, dispersed non-hook fiber bundles of micro-fibriform pile will not be tangled together, enhancing the fastening ability of the fastening fabric.

21 Claims, 5 Drawing Sheets

FASTENING FABRIC STRUCTURE

BACKGROUND OF THE INVENTION

1. Field of the Invention

The present invention relates to fabrics and more particularly, to a fastening fabric structure having the similar fastening effect of traditional VELCRO.

2. Description of the Related Art

VELCRO, a leading brand of hook and loop fastening fabric, as a conventional fastening or gripping fabrics can be found in our living environment and widely used in garment, leather goods, shoes, diaper, helmet, etc. The major reason is that the VELCRO is convenient in fastening.

However, there are some unsatisfied drawbacks in using VELCRO, for example, VELCRO, stiff in texture, has a certain thickness and is difficult produced and directly connected to the fabric. Normally, it should be by sewing or other ways to attach or connect the VELCRO on the articles which using said VELCRO. Therefore, if the articles using VELCRO requires to be soft in texture or less thick than the thickness of VELCRO, due to the texture of VELCRO material, the VELCRO is difficult to meet such requirements.

Taiwan Utility Model Publication No. 479477 is relating to thin base fabrics having loops surface knitted by monofilaments. It disclosed pile loop fabric structure with a base fabric which formed by each weft filament being knitted to become a node then each adjacent nodes being interlocked to form a pair of inlay, then, by interlocking continuous nodes to form the strips of combining the base warp tissues. That means, the base fabrics of said pile loop fabrics is made by monofilaments, under special knitting for to the curving floating circles thereby providing a thinner pile loop fabric. The fact prevents the trouble caused by the thickness of VELCRO.

Beside the above-mentioned thickness issue, there is still a problem of unintended adherence. The reason is that the loops of convention fastening fabrics are too large in dimension which providing the opportunity of small things to insert through or fall within the loops.

Further, Taiwan Utility Model Publication Number M263013 (equivalent to U.S. Pat. No. 7,231,789 B2), issued to the present inventor, discloses a fastening fabric structure entitled "Snapping Fabrics". According to this invention, a hairiness treatment of brushing and shearing is applied to form fibriform hook. However, employing a brushing technique to form fibriform hook cannot keep fibriform hook in direction, lowering the fastening ability. Further, the fibriform hook tends to be tangled together, forming pilling and loosing the fastening ability.

SUMMARY OF THE INVENTION

The present invention has been accomplished under the circumstances in view. It is therefore the main object of the present invention to provide a fastening fabric structure having a micro-fibriform loop fabric and a fibriform pile fabric wherein the micro-fibriform loop fabric is treated through a splitting process to form micro-fibriform loops or pile loops located between two adjacent inter-weaving or inter-knitting nodes (i.e., two adjacent intersections of interlacing or interloops), and the fibriform pile fabric is treated through a shearing process to form erected, dispersed non-hook fiber bundles of fibriform pile for fastening the micro-fibriform loops of the micro-fibriform loop fabric, and therefore the erected, dispersed non-hook fiber bundles of fibriform pile will not be tangled together, enhancing the fastening ability of the fastening fabric.

To achieve this and other objects of the present invention, a fastening fabric structure comprises a micro-fibriform loop fabric and a fibriform pile fabric. The micro-fibriform loop fabric is fabricated by complex, textured micro-fiber yarn and split thereafter to recover more and smaller fibers, substantially all of the fibers forming the micro-fibriform loops or pile loops located between inter-weaving or inter-knitting nodes (i.e., two adjacent intersections of interlacing or interloops). The fibriform pile fabric is fabricated by spun yarn or synthetic filament yarn having fibriform pile loops and then sheared the top of pile loops to form erected, dispersed non-hook fiber bundles of fibriform pile for fastening the micro-fibriform loops of said micro-fibriform loop fabric.

DETAILED DESCRIPTION OF THE PREFERRED EMBODIMENT

Figure 1:
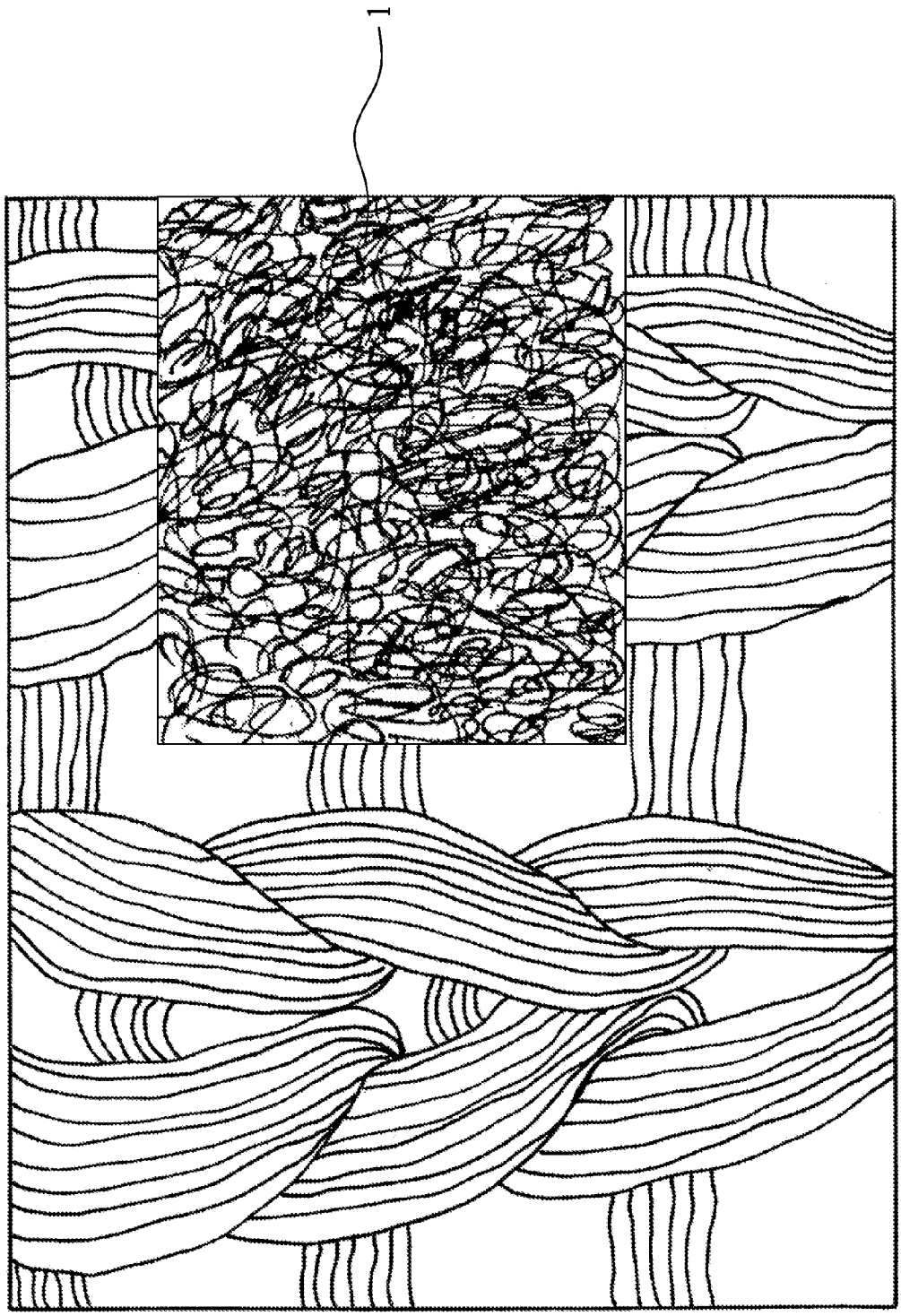
FIG. 1 is a schematic view in an enlarged scale of the present invention, showing the complex textured micro-fiber yarns of micro-fibriform loop fibers partially split and partially not split.
Figure 2:
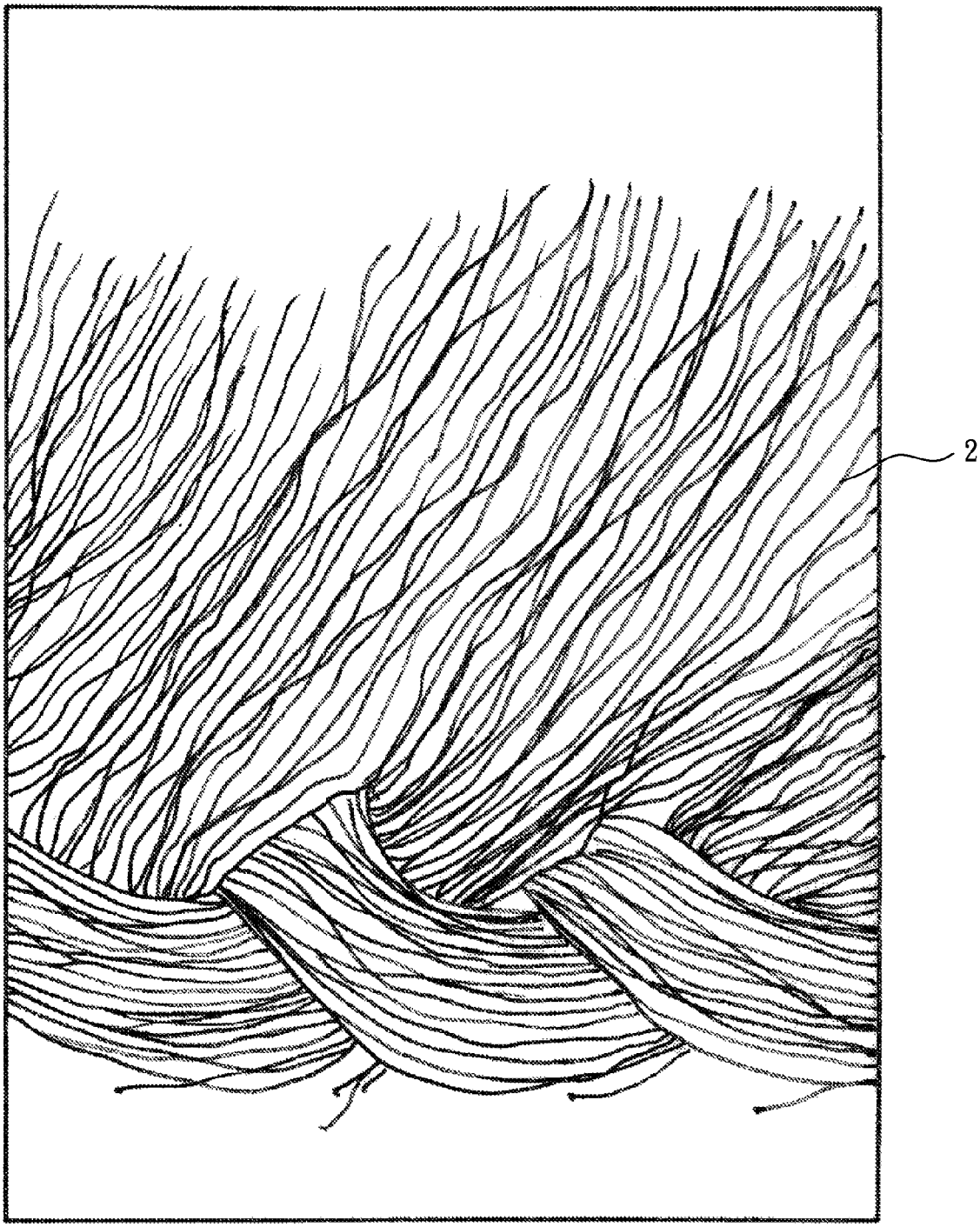
FIG. 2 is a schematic enlarged view of a part of the present invention, showing the structure of the fibriform pile fabric.

As shown in FIGS. 1 and 2, basically, a fastening fabric structure in accordance with the present invention comprises a micro-fibriform loop fabric 1 and a fibriform pile fabric 2.

Referring to FIG. 1, the micro-fibriform loop fabric 1 including plurality of micro-fibriform loops or pile loops which are the intensive and loosen single micro-fiber of the yarn located between two adjacent inter-knitting nodes (i.e., two adjacent intersections of interlacing or interloops). Actually, these micro-fibriform loops are functioning similar to the loops of a conventional VELCRO tape.

In actual practice, the micro-fibriform loop fabric 1 can be made by micro-fiber, which has the diameter, less than 1 denier. The production of micro-fiber is mature technology. As shown in FIG. 1, the normal process may adopt two different high molecular materials become the complex filament by complex spinning and then separating each single complex fiber (normally call splitting) into a bunch of microfibers. Therefore, the micro-fibriform loop fabric 1 of the present invention is by knitting the micro-fiber yarn then splitting them to form the loosen but intensive micro-fibriform loops or pile loops between the inter-knitting nodes of the yarn. The method of splitting can be carried out by chemical process as well as mechanical process. The chemical process is by chemical substance (i.e. alkali corrosive substance) to dissolve one of the two materials but leave the other one. If by the mechanical method, two different complex fibers can be separated by mechanically rubbing.

The fibriform pile fabric 2 including a plurality of fibriform pile, which are knitted by spun yarn including nature fiber and synthetic staple fiber or textured filament yarn. The fibriform pile of the fibriform pile fabric 2, no matter knitted by filaments or staple fibers, can be formed by: 1) shearing pile loop fabrics, either knitted or woven, to form uniform, erected, dispersed non-hook fiber bundles; 2) shearing knitted or woven corduroy fabrics in weft or warp direction to form uniform, erected, dispersed non-hook fiber bundles; 3) cutting a knitted or woven double-layer fabric into two pieces and then shearing one side of the two pieces of knitted or woven double-layer fabric sheared to provide erected, dispersed non-hook fiber bundles of fibriform pile, wherein the fiber of each fibriform pile has a rough surface after alkali corrosive substance finishing for more tightly fastening the micro-fibriform loops of the micro-fibriform loop fabric. Therefore, subject to one of the aforesaid three fibriform pile formation methods, the fibriform pile fabric 2 has the similar function of hook elements of conventional VELCRO tapes.

In actual practice, when the fibriform pile fabric 2 and the micro-fibriform loop fabric 1 are bonded face to face, the erected fibers of the fibriform pile fabric 2 will be fastened or restrained by micro-fibriform loop fabric 1, thereby achieving the anti-pulling effect or adherence, which the conventional surface fastener VELCRO tapes have.

Figure 3:
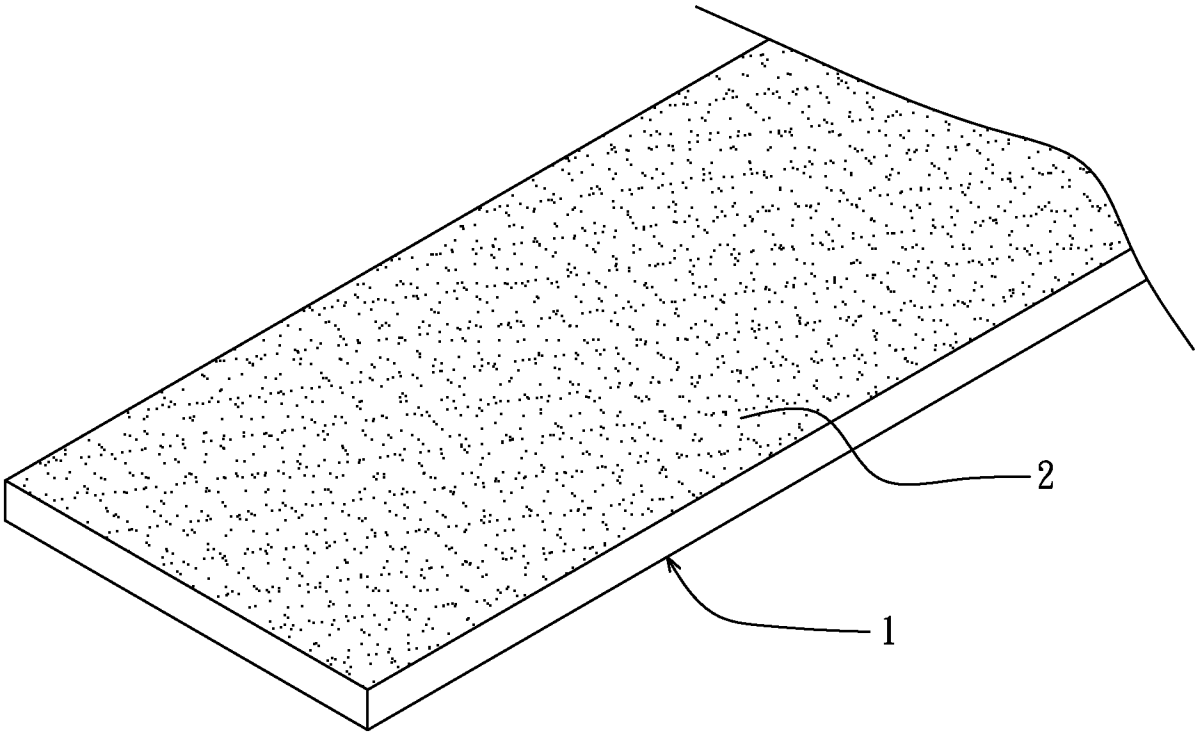
FIG. 3 is a schematic view of the present invention, showing the micro-fibriform loops and the fibriform pile are fabricated individually on the opposite surface of fabric.
Figure 4:
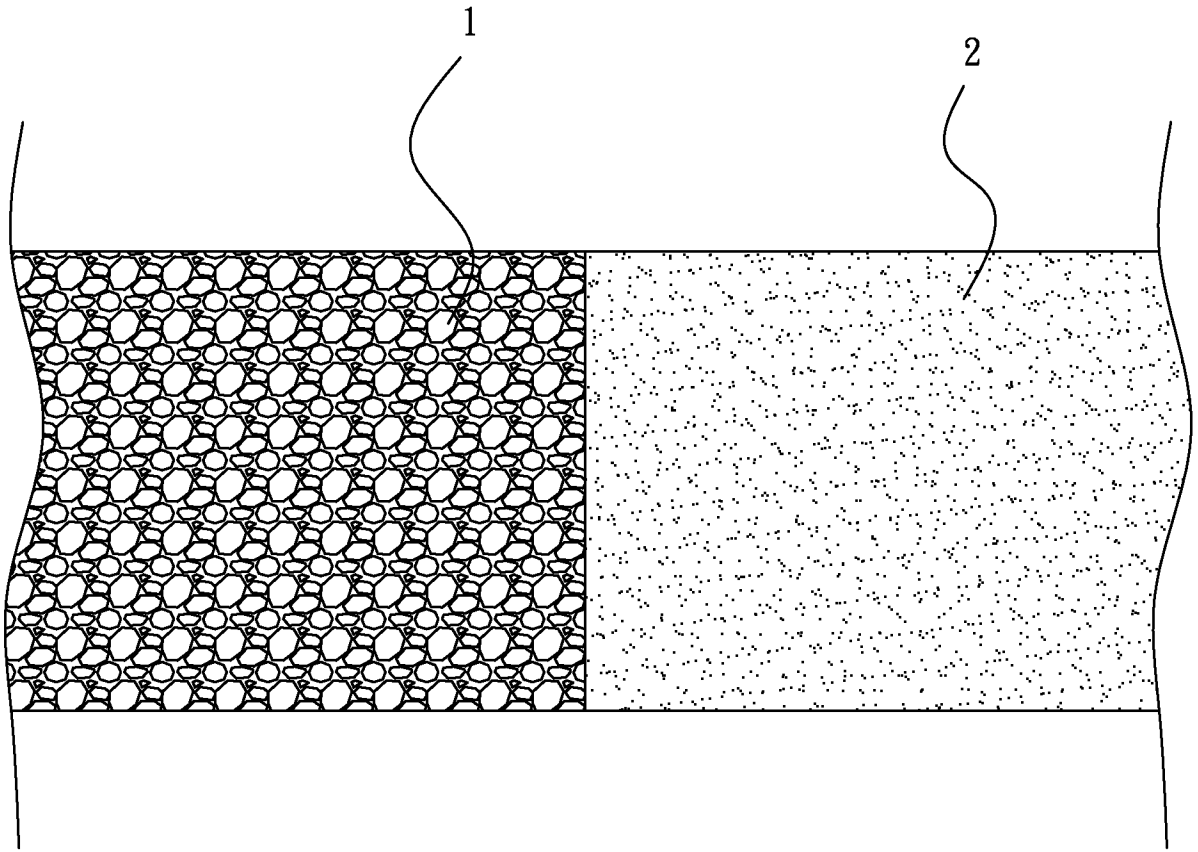
FIG. 4 shows the micro-fibriform loop and the fibriform pile are fabricated at different locations on one same side of a fabric according to the present invention.
Figure 5:
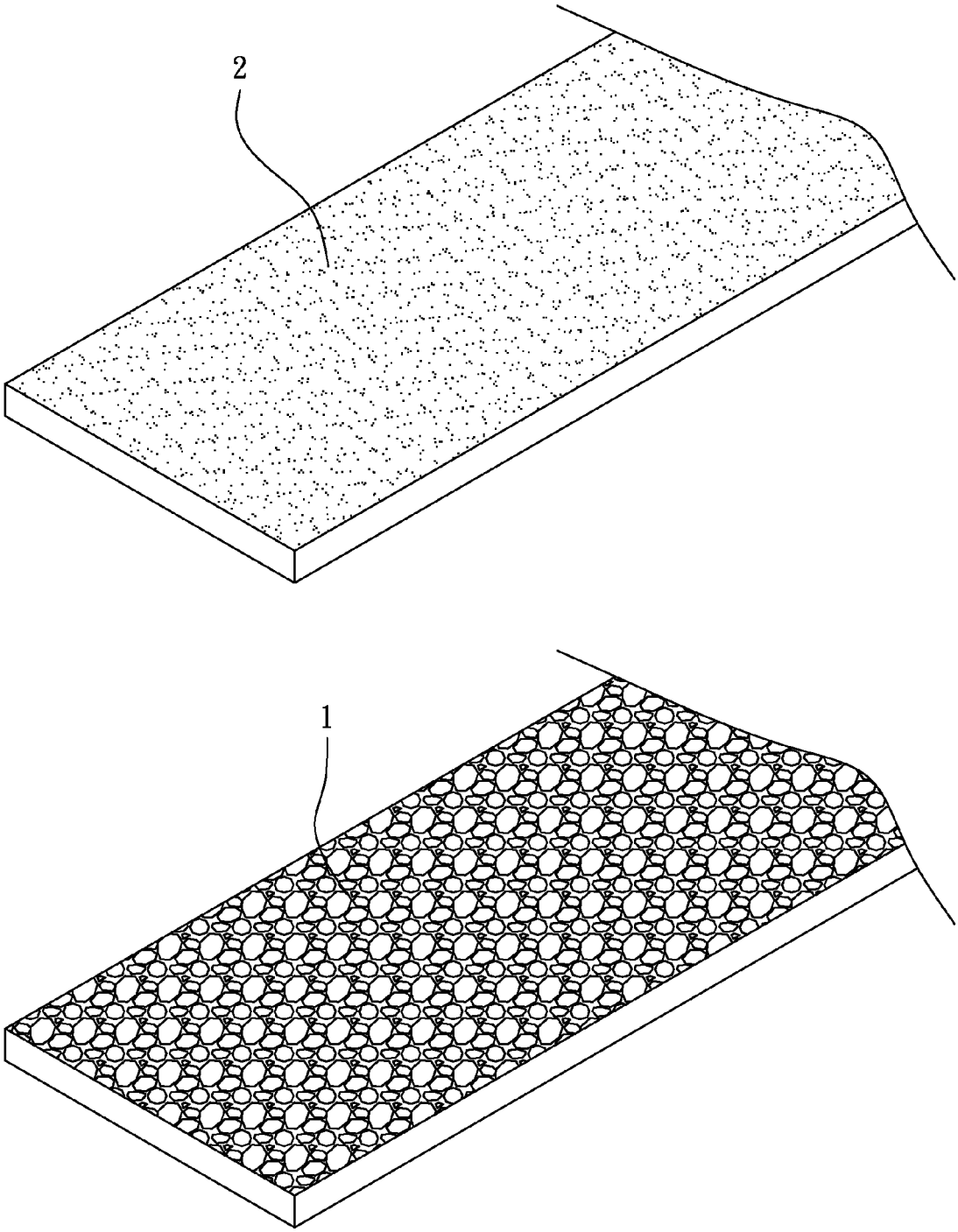
FIG. 5 shows the micro-fibriform loop and the fibriform pile are respectively fabricated on two different fabric pieces before bonding according to the present invention.

Subject to the application, the micro-fibriform loop fabric 1 and the fibriform pile fabric 2 can be, as shown in FIG. 3, fabricated at opposite sides by terry or velour knitting machines; or as shown in FIG. 4, the micro-fibriform loop fabric 1 and the fibriform pile 2 can be fabricated at different locations on the same side; or as shown in FIG. 5, the micro-fibriform loop fabric 1 and the fibriform pile 2 can be respectively fabricated on two different fabric pieces before bonding.

Therefore, by adopting the present invention, the advantages and effects can be achieved are:

1) Due to the use of micro-fiber and knitted them as part of the fabrics directly, wherein the micro-fibriform loops and the fibriform pile are all form by and integrated with the fastening fabric, so that the thickness can be effectively reduced.

2) Because the fastening fabrics of the present invention forms the loops and pile directly on the surface of fabrics without base cloth or base substrate, therefore, based on the soft texture, when used as a band strip, it can be rolled or wrapped to the body directly, tightly and closely.

3) The diameter of fibriform pile is similar to nature cotton fiber, especially micro-fibriform loop is much smaller than nature cotton fiber, except it can prevent the user from skin stimulating, also prevent the other thing from insert or fall within fabrics, by which, maintain the longer adhere life.

4) The fibriform pile of the fibriform pile fabric are erected non-hook fibers that do not damage the micro-fibers of the micro-fibriform loops of the micro-fibriform loop fabric; the whole-surface engagement between the micro-fibriform loops of the micro-fibriform loop fabric and the erected non-hook fibers of the fibriform pile of the fibriform pile fabric allows even distribution of force through the whole contact surface area, thereby reducing the force applied to the specific area of surface and enhancing the fastening power and the durability of the fastening fabrics, and meeting the essential requirement of repeated use for environment-friendly materials.

5) The fastening fabric is made like the regular knitting or weaving cloths of the soft clothing, and can be cut freely to use as bandages or supports directly subject to any desired shapes for whole-surface fastening without any other closure means; when used as a band strip, one single piece of band strip can be used to wrap different parts of the body; due to a wide range of fastening application, the invention is a breakthrough in fastening fabric industry.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A fastening fabric structure comprising:

a micro-fibriform loop fabric fabricated from a textured composite fiber yarn being a micro-fiber yarn, said micro-fibriform loop fabric is knitted or woven by said micro-fiber yarn and having inter-weaving or inter-knitting nodes, said textured composite fiber yarn is split thereafter to recover at least two fibers having a size less than one denier, substantially all of the fibers forming micro-fibriform loops are located between two adjacent intersections of interlacing or interlooping; and a fibriform pile fabric fabricated from a spun yarn or synthetic filament yarn and then sheared forming non-hook fiber bundles of fibriform pile for fastening the micro-fibriform loops of said micro-fibriform loop fabric, said non-hook fiber bundles of said fibriform pile fabric are uniform, erect, and dispersed fiber bundles;

wherein the fibriform pile of said fibriform pile fabric are knitted or woven by synthetic filament yarn or spun yarn including nature and synthetic fiber, said non-hook fiber bundles being formed by shearing tops of fibriform pile loops of said fibriform pile fabric, said non-hook fiber bundles of said fibriform pile fabric extending outwardly from a surface of said fibriform pile fabric in a z-direction relative to said surface of said fibriform pile fabric.

2. The fastening fabric structure as claimed in claim 1, wherein said textured composite fiber yarn is split by a chemical method.

3. The fastening fabric structure as claimed in claim 1, wherein said textured composite fiber yarn is split by a mechanical method.

4. The fastening fabric structure as claimed in claim 1, wherein the fibriform pile and micro-fibriform loops are fabricated individually on the opposite surface of fabric.

5. The fastening fabric structure as claimed in claim 1, wherein the fibriform pile and micro-fibriform loops are fabricated on different portions of same surface of fabric.

6. The fastening fabric structure as claimed in claim 1, wherein the fibriform pile and micro-fibriform loops are fabricated on two different pieces of fabrics.

7. The fastening fabric structure as claimed in claim 6, wherein the fibriform pile and micro-fibriform loops are fabricated on two different pieces of fabrics that are bonded together to form a double-sided self-adhered fastening fabric.

8. A fastening fabric structure comprising:

a micro-fibriform loop fabric fabricated from a textured composite fiber yarn being a micro-fiber yarn, said micro-fibriform loop fabric is knitted or woven by said micro-fiber yarn and having inter-weaving or inter-knitting nodes, said textured composite fiber yarn is split thereafter to recover at least two fibers having a size less than one denier, substantially all of the fibers forming micro-fibriform loops are located between two adjacent intersections of interlacing or interlooping; and a fibriform pile fabric fabricated from a spun yarn or synthetic filament yarn and then sheared forming non-hook fiber bundles of fibriform pile for fastening the micro-fibriform loops of said micro-fibriform loop fabric, said non-hook fiber bundles of said fibriform pile fabric are uniform, erect, and dispersed fiber bundles;

wherein the fibriform pile of said fibriform pile fabric is a woven corduroy fabric sheared in weft or warp direction to form said erected, dispersed non-hook fiber bundles of fibriform fiber, said non-hook fiber bundles being formed by shearing tops of fibriform pile loops of said fibriform pile fabric, said non-hook fiber bundles of said fibriform pile fabric extending outwardly from a surface of said fibriform pile fabric in a z-direction relative to said surface of said fibriform pile fabric.

9. The fastening fabric structure as claimed in claim 8, wherein said textured composite fiber yarn is split by a chemical method.

10. The fastening fabric structure as claimed in claim 8, wherein said textured composite fiber yarn is split by a mechanical method.

11. The fastening fabric structure as claimed in claim 8, wherein the fibriform pile and micro-fibriform loops are fabricated individually on the opposite surface of fabric.

12. The fastening fabric structure as claimed in claim 8, wherein the fibriform pile and micro-fibriform loops are fabricated on different portions of same surface of fabric.

13. The fastening fabric structure as claimed in claim 8, wherein the fibriform pile and micro-fibriform loops are fabricated on two different pieces of fabrics.

14. The fastening fabric structure as claimed in claim 13, wherein the fibriform pile and micro-fibriform loops are fabricated on two different pieces of fabrics that are bonded together to form a double-sided self-adhered fastening fabric.

15. A fastening fabric structure comprising:

a micro-fibriform loop fabric fabricated from a textured composite fiber yarn being a micro-fiber yarn, said micro-fibriform loop fabric is knitted or woven by said micro-fiber yarn and having inter-weaving or inter-knitting nodes, said textured composite fiber yarn is split thereafter to recover at least two fibers having a size less than one denier, substantially all of the fibers forming micro-fibriform loops are located between two adjacent intersections of interlacing or interlooping; and a fibriform pile fabric fabricated from a spun yarn or synthetic filament yarn and then sheared forming non-hook fiber bundles of fibriform pile for fastening the micro-fibriform loops of said micro-fibriform loop fabric, said non-hook fiber bundles of said fibriform pile fabric are uniform, erect, and dispersed fiber bundles;

wherein the fibriform pile of said fibriform pile fabric are knitted or woven double-layer fabric cut into two pieces and one surface of said two pieces providing said erected, dispersed non-hook fiber bundles of fibriform fiber, said non-hook fiber bundles being formed by shearing tops of fibriform pile loops of said fibriform pile fabric, said non-hook fiber bundles of said fibriform pile fabric extending outwardly from said one surface of said two pieces of said fibriform pile fabric in a z-direction relative to said one surface of said two pieces of said fibriform pile fabric.

16. The fastening fabric structure as claimed in claim 15, wherein said textured composite fiber yarn is split by a chemical method.

17. The fastening fabric structure as claimed in claim 15, wherein said textured composite fiber yarn is split by a mechanical method.

18. The fastening fabric structure as claimed in claim 15, wherein the fibriform pile and micro-fibriform loops are fabricated individually on the opposite surface of fabric.

19. The fastening fabric structure as claimed in claim 15, wherein the fibriform pile and micro-fibriform loops are fabricated on different portions of same surface of fabric.

20. The fastening fabric structure as claimed in claim 15, wherein the fibriform pile and micro-fibriform loops are fabricated on two different pieces of fabrics.

21. The fastening fabric structure as claimed in claim 20, wherein the fibriform pile and micro-fibriform loops are fabricated on two different pieces of fabrics that are bonded together to form a double-sided self-adhered fastening fabric.

* * * * *